US012311986B2

(12) United States Patent
Peltz

(10) Patent No.: US 12,311,986 B2
(45) Date of Patent: May 27, 2025

(54) SYSTEM AND METHOD FOR VEHICLE CONTROL BASED ON DETECTED WHEEL CONDITION

(71) Applicant: Transportation IP Holdings, LLC, Norwalk, CT (US)

(72) Inventor: David Michael Peltz, Melbourne, FL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 481 days.

(21) Appl. No.: 17/551,285

(22) Filed: Dec. 15, 2021

(65) Prior Publication Data

US 2022/0105969 A1 Apr. 7, 2022

Related U.S. Application Data

(63) Continuation-in-part of application No. 16/704,298, filed on Dec. 5, 2019, now Pat. No. 11,230,306, which is a continuation of application No. 15/486,121, filed on Apr. 12, 2017, now Pat. No. 10,525,991.

(60) Provisional application No. 62/328,693, filed on Apr. 28, 2016.

(51) Int. Cl.

| | |
|---|---|
| ***B61K 9/12*** | (2006.01) |
| ***B61L 15/00*** | (2006.01) |
| ***B61L 25/02*** | (2006.01) |
| ***B61L 27/04*** | (2006.01) |

(52) U.S. Cl.

CPC ..... *B61K 9/12* (2013.01); *B61L 15/0018* (2013.01); *B61L 15/009* (2013.01); *B61L 25/021* (2013.01); *B61L 2201/00* (2013.01)

(58) Field of Classification Search

CPC ..... B61K 9/12; B61L 15/0018; B61L 15/009; B61L 25/021; B61L 27/04; B61L 2201/00; B61L 15/0081

See application file for complete search history.

(56) References Cited

U.S. PATENT DOCUMENTS

| | | | |
|---|---|---|---|
| 4,635,150 | A | 1/1987 | Kato et al. |
| 4,721,045 | A | 1/1988 | Okawa et al. |
| 4,767,475 | A | 8/1988 | Fukuda et al. |
| 4,876,966 | A | 6/1989 | Okawa et al. |
| 5,188,038 | A | 2/1993 | Shanley |
| 5,429,329 | A | 6/1995 | Wallace et al. |
| 5,492,290 | A | 2/1996 | Quinn et al. |
| 5,590,856 | A | 1/1997 | Quinn et al. |
| 5,868,541 | A | 2/1999 | Tajima |
| 5,987,979 | A | 11/1999 | Bryan |

(Continued)

*Primary Examiner* — Alan D Hutchinson
(74) *Attorney, Agent, or Firm* — K&L Gates LLP

(57) ABSTRACT

A system is provided that includes a detection circuit having a first and second sensor. The first sensor is configured to measure a rotational speed of a first wheel. The second sensor is coupled to a vehicle chassis and configured to measure a position over time of the vehicle chassis. The system further includes a controller circuit configured to determine a shock frequency based on the position of the vehicle chassis. The controller circuit is further configured to determine a condition (e.g., an anomalous condition) of the first wheel based on the shock frequency and the rotational speed, and may be further configured for vehicle control based on the determined condition.

19 Claims, 6 Drawing Sheets

(56) References Cited

U.S. PATENT DOCUMENTS

| | | | | |
|---|---|---|---|---|
| 6,155,766 | A | 12/2000 | Ostwald et al. | |
| 6,216,985 | B1 | 4/2001 | Stephens | |
| 6,267,059 | B1 | 7/2001 | Brandt | |
| 6,329,956 | B1 | 12/2001 | Tateishi et al. | |
| 6,412,332 | B1 | 7/2002 | Bartonek | |
| 6,476,603 | B2 | 11/2002 | Clark et al. | |
| 6,600,999 | B2 | 6/2003 | Clark et al. | |
| 6,604,421 | B1 | 8/2003 | Li | |
| 7,278,305 | B2 | 10/2007 | Kilian et al. | |
| 7,461,599 | B2 | 12/2008 | Hachikawa | |
| 7,681,443 | B2 | 5/2010 | Kilian et al. | |
| 7,784,840 | B2 | 8/2010 | Leslie | |
| 8,468,244 | B2 | 6/2013 | Redlich et al. | |
| 8,468,948 | B2 | 6/2013 | Delmonico et al. | |
| 8,589,256 | B2 | 11/2013 | Tays et al. | |
| 8,934,007 | B2 | 1/2015 | Snead | |
| 10,525,991 | B2 | 1/2020 | Peltz | |
| 11,230,306 | B2 | 1/2022 | Peltz | |
| 2004/0006411 | A1 | 1/2004 | Kane et al. | |
| 2007/0208841 | A1* | 9/2007 | Barone ..... | B61L 15/0027 709/223 |
| 2016/0101792 | A1 | 4/2016 | Bartonek et al. | |
| 2017/0158212 | A1 | 6/2017 | Wennekamp | |
| 2018/0222504 | A1 | 8/2018 | Birch et al. | |
| 2019/0041296 | A1 | 2/2019 | Carroll | |

* cited by examiner

SYSTEM AND METHOD FOR VEHICLE CONTROL BASED ON DETECTED WHEEL CONDITION

CROSS-REFERENCE TO RELATED APPLICATIONS

This application is a continuation-in-part of U.S. patent application Ser. No. 16/704,298, filed 5 Dec. 2019, which is a continuation of U.S. patent application Ser. No. 15/486,121, filed 12 Apr. 2017, which, in turn, claims priority to U.S. Provisional Application No. 62/328,693 filed on 28 Apr. 2016. The entire disclosures of these applications are incorporated herein by reference.

FIELD

Embodiments of the subject matter described herein relate to vehicle control.

BACKGROUND

When a vehicle travels along a route, continual vibrations and/or rapid changes in vertical position (e.g., shocks) can occur. Repeated shocks may indicate damage to the wheel of the vehicle. For example, the rolling surface of the wheel may become damaged and/or broken over time. The damaged sections of the wheel may create shock and/or impact loads to both the wheel and the surface of the route traveled by the vehicle. If the damaged section and/or the wheel is not detected, the damaged section of the wheel may cause damage to the vehicle. For example, damaged wheels on a rail vehicle may cause a derailment of the rail vehicle from the tracks resulting in a wreck. In another example, the continual shock may indicate the wheel is misaligned along the route, such as traversing along railroad ties of the track, and derailment of the rail vehicle is imminent. Conventional detecting systems only measure a shock magnitude, which lacks the selective response needed for avoiding false positives.

BRIEF DESCRIPTION

In one embodiment, a system (e.g., a vehicle control system) includes a detection circuit having a first sensor and a second sensor. The first sensor is configured to measure a rotational speed of a first wheel. The second sensor is coupled to a vehicle chassis and configured to measure a position over time of the vehicle chassis. The system further includes a controller circuit configured to determine a shock frequency based on the position of the vehicle chassis. The controller circuit is further configured to determine a condition (e.g., an anomalous condition) of the first wheel based on the shock frequency and the rotational speed. In another aspect, the vehicle may be controlled (e.g., vehicle movement) based on the condition that is determined.

In another embodiment, a method (e.g., method for vehicle control) includes acquiring a rotational speed of a first wheel from a first sensor, acquiring a position over time of a vehicle chassis from a second sensor, calculating a shock frequency based on the position of the vehicle chassis, and determining a condition (e.g., an anomalous condition) of the first wheel based on the shock frequency and the rotational speed. The method may further include controlling the vehicle based on the condition that is determined.

In another embodiment, a method (e.g., method for vehicle control based on detecting anomalous conditions of one or more wheels) includes receiving a speed measurement signal from a first sensor and a position measurement signal from a second sensor. The speed measurement signal corresponds to a rotational speed of a first wheel. The position measurement signal corresponding to a position of a vehicle chassis. The method further includes identifying a plurality of anomalies in the position measurement signal, calculating a shock frequency based on at least a portion of the plurality of anomalies, and determining an anomalous condition of the first wheel based on the shock frequency and the rotational speed. The method may further include controlling the vehicle based on the condition that is determined.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Various embodiments described herein provide systems and methods for detecting anomalous conditions of a wheel of a vehicle traveling along a route. The anomalous conditions correspond to one or more rolling surface anomalies of the wheel. For example, the anomalous conditions may correspond to a change in shape of the wheel, defects in the route, changes of the rolling surface within a time period, and/or the like. The anomalous conditions are identified and/or classified based on a wheel velocity, and shock (e.g., vertical displacement) and/or vibrations of the vehicle when traveling along the route. Reoccurring anomalies can indicate damage and/or misalignment of the wheel with respect to the route. For example, the anomalies (e.g., shock and/or vibrations of the vehicle) can be periodic having a corresponding shock frequency based on a relationship with the wheel (e.g., diameter, size, rotational speed) and/or the route. Various embodiments determine the relationship of the shock frequency with the wheels and/or route to determine a classification of the anomalous condition. For example, a damaged section of the wheel may form a flat surface of the rolling surface of the wheel. When the vehicle is traveling along the route, a frequency of the shocks and impact of the vehicle occur to both the wheel and the route relative to a rotational speed and diameter of the wheel. Based on the relationship of the shock frequency with the wheel (e.g., rotational speed, diameter), the anomalous condition may be classified as wheel damage. In another example, a wheel of a rail vehicle may be derailed traversing along the railroad ties of the route. When the rail vehicle is traveling along the route, a frequency of the shocks and impact of the vehicle occur to both the wheel and the route relative to a rotational speed of the wheel and the spacing of the railroad ties. Based on the relationship of the shock frequency with the wheel (e.g., rotational speed) and the railroad ties, the anomalous condition may be classified as the wheel being derailed. Optionally, based on the classification of the anomalous condition various embodiments may perform automatic responses, such as adjust a speed of the vehicle, alert an operator of the vehicle, adjust a schedule of the vehicle, and/or the like.

While the discussion and figures included herein may be interpreted as focusing on rail vehicle consists (e.g., trains) as the vehicle systems, it should be noted that not all embodiments of the subject matter herein described and claimed herein are limited to trains and railroad tracks. (A consist is a group of vehicles that are mechanically linked to travel together.) The inventive subject matter may apply to other vehicles, such as airplanes, automobiles, and/or the like.

Figure 1:
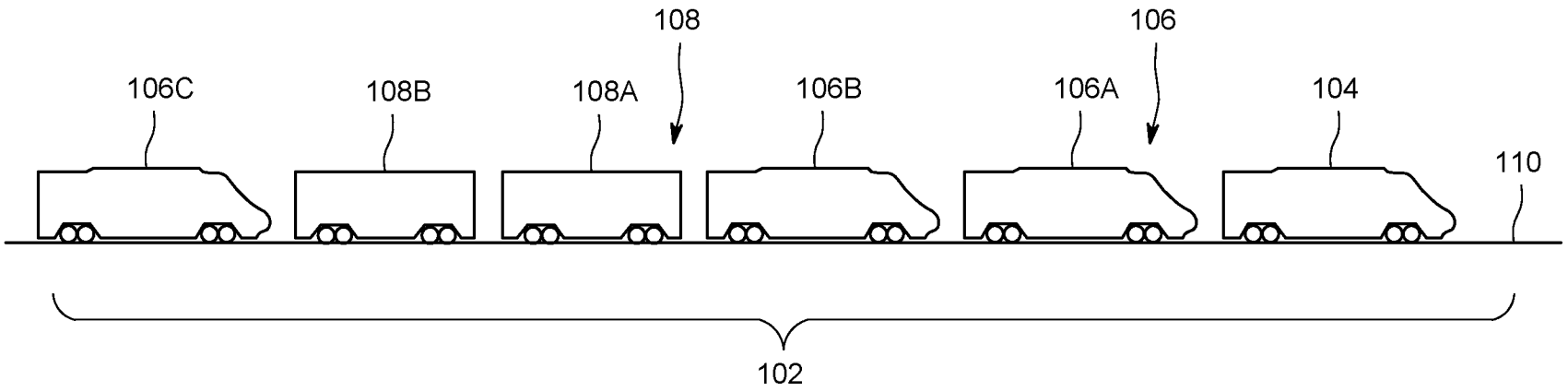
FIG. 1 illustrates a vehicle system, in accordance with an embodiment.

FIG. 1 illustrates one embodiment of a vehicle system 102. The illustrated vehicle system 102 includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles 104, 106, 108 are shown as being mechanically coupled with each other, optionally, the vehicles 104, 106, 108 may not be mechanically coupled with each other. Alternatively, the vehicle system 102 may include only a single vehicle 104, 106, or 108.

The propulsion-generating vehicles 104, 106 are shown as locomotives, the non-propulsion-generating vehicles 108 are shown as rail cars, and the vehicle system 102 is shown as a train in the illustrated embodiment. It may be noted that in other embodiments, the vehicles 104, 106, 108 may represent other vehicles, such as automobiles, airplanes, and/or the like. Optionally, the vehicle system 102 can represent a grouping or coupling of these other vehicles. The number and arrangement of the vehicles 104, 106, 108 in the vehicle system 102 are provided as one example and are not intended as limitations on all embodiments of the subject matter described herein.

Optionally, groups of one or more adjacent or neighboring propulsion-generating vehicles 104 and/or 106 may be referred to as a vehicle consist. For example the vehicles 104, 106A, 106B may be referred to as a first vehicle consist of the vehicle system 102 and the vehicle 106C referred to as a second vehicle consist of the vehicle system 102. Alternatively, the vehicle consists may be defined as the vehicles that are adjacent or neighboring to each other, such as a vehicle consist defined by the vehicles 104, 106A, 106B, 108A, 108B, 106C.

The propulsion-generating vehicles 104, 106 may be arranged in a distributed power (DP) arrangement. For example, the propulsion-generating vehicles 104, 106 can include a lead vehicle 104 that issues command messages to the other propulsion-generating vehicles 106A, 106B, 106C which are referred to herein as remote vehicles. The designations "lead" and "remote" are not intended to denote spatial locations of the propulsion-generating vehicles 104, 106 in the vehicle system 102, but instead are used to indicate which propulsion-generating vehicle 104, 106 is communicating (e.g., transmitting, broadcasting, or a combination of transmitting and broadcasting) command messages and which propulsion-generating vehicles 104, 106 are being remotely controlled using the command messages. For example, the lead vehicle 104 may or may not be disposed at the front end of the vehicle system 102 (e.g., along a direction of travel of the vehicle system 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-propulsion-generating vehicles 108.

Figure 2:
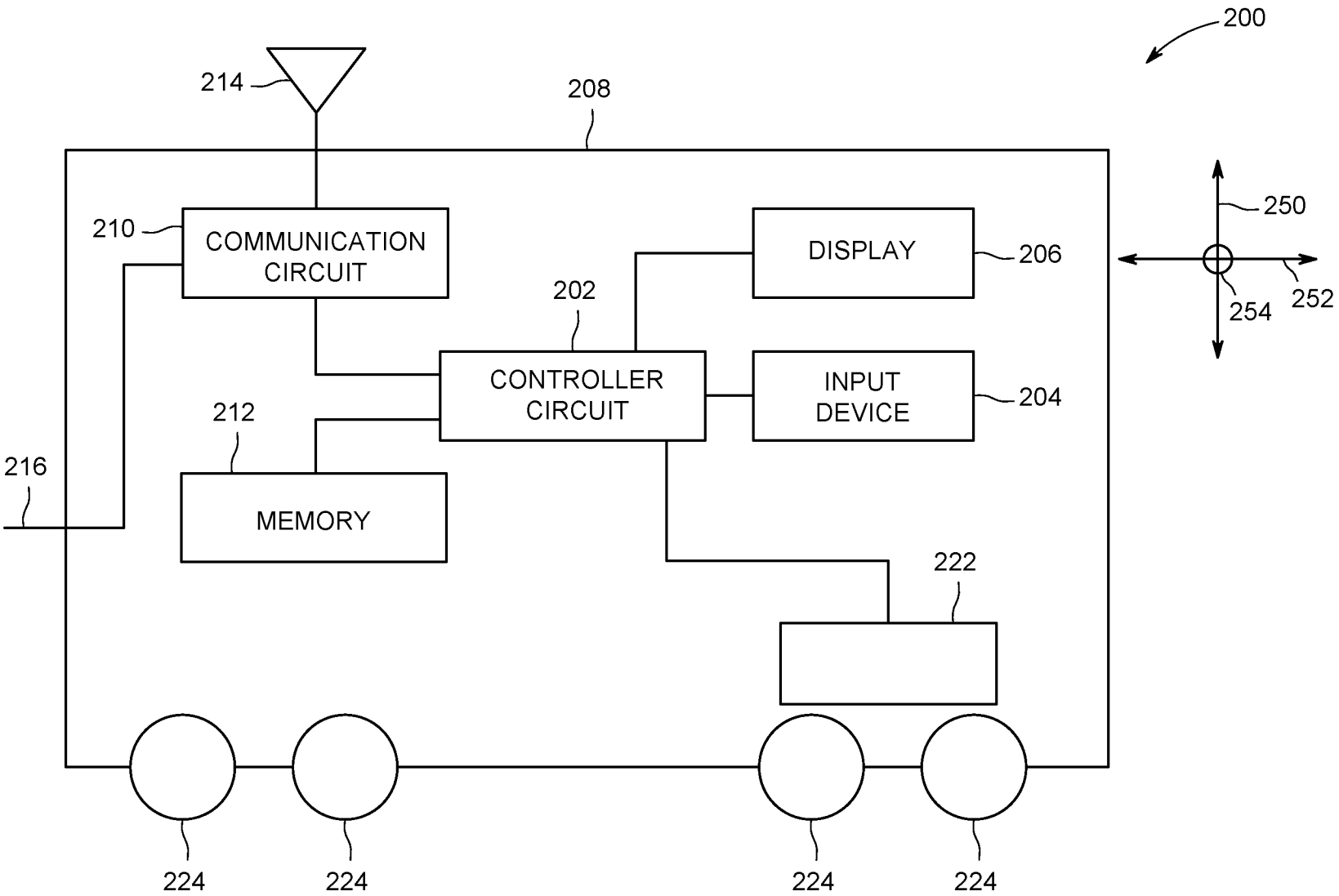
FIG. 2 is a schematic diagram of a vehicle of the vehicle system shown in FIG. 1, in accordance with an embodiment.

FIG. 2 is a schematic diagram of an embodiment of a vehicle 200 of the vehicle system 102, in accordance with an embodiment. For example, the vehicle 200 may be one of the propulsion-generating vehicles 104, 106 and/or one of the non-propulsion-generating vehicles 108. The vehicle 200 may include a controller circuit 202 that controls operations of the vehicle 200 enclosed within a chassis 208 of the vehicle 200. The controller circuit 202 may include or represent one or more hardware circuits or circuitry that include, are connected with, or that both include and are connected with one or more processors, controllers, or other hardware logic-based devices.

The controller circuit 202 may be connected with a communication circuit 210. The communication circuit 210 may represent hardware that is used to communicate with other vehicles communicatively coupled to the vehicle 200 (e.g., the vehicles 104-108) within the vehicle system 102, one or more dispatch stations, a remote system, and/or the like. For example, the communication circuit 210 may include a transceiver and associated circuitry (e.g., antennas) 214 for wirelessly communicating (e.g., communicating and/or receiving) linking messages, command messages, linking confirmation messages, reply messages, retry messages, repeat messages, status messages, and/or the like. Optionally, the communication circuit 210 includes circuitry for communicating the messages over a wired connection 216, such as a multiple unit (MU) line of the vehicle 200, Ethernet, and/or the like.

A memory 212 may be may be used for storing data. For example, the data may be associated with information acquired by a detection circuit 222 (e.g., shock frequency, rotational speed of wheels 224, and/or the like), route characteristic information (e.g., railway tie spacing, rumble strip spacing, and/or the like), wheel characteristic information (e.g., size, circumference, diameter, and/or the like), firmware or software corresponding to, for example, a graphical user interface, programmed instructions for one or more components in the vehicle 200 (e.g., the controller circuit 202, the detection circuit 222, and/or the like). The memory 112 may be a tangible and non-transitory computer readable medium such as flash memory, RAM, ROM, EEPROM, and/or the like.

Figure 3:
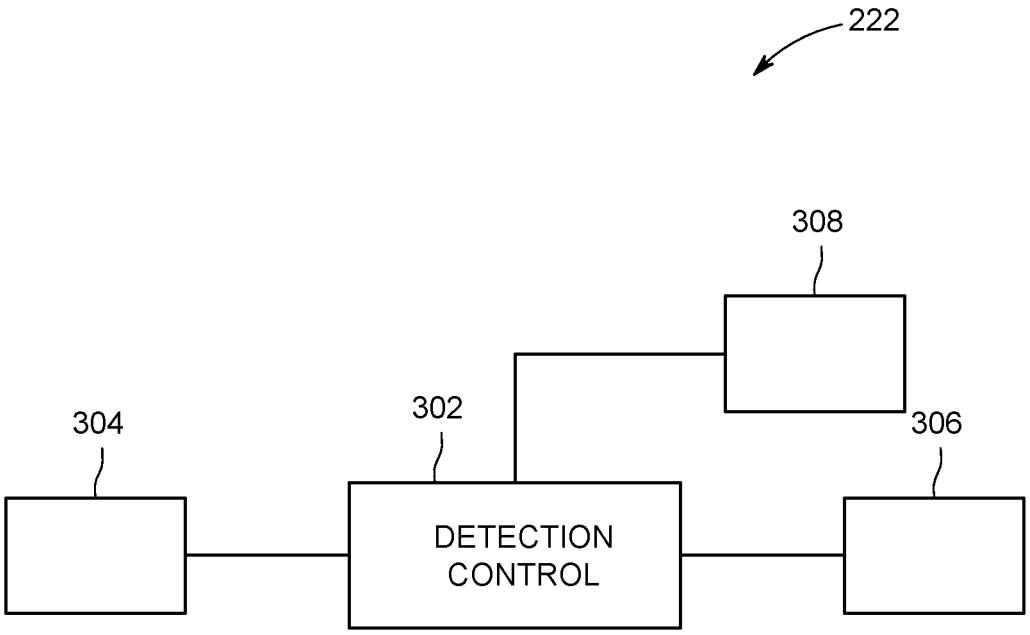
FIG. 3 is a schematic diagram of a detection circuit, in accordance with an embodiment.

The controller circuit 202 may be operably coupled to the detection circuit 222. FIG. 3 illustrates a schematic diagram of an embodiment of the detection circuit 222. The detection circuit 222 may include a detection control circuit 302, a plurality of sensors 304, 306, and a memory 308. The detection circuit 222 may be configured to measure rotational speeds of the wheel 224 and a shock frequency of the vehicle 200. Additionally or alternatively, the detection circuit 222 may be configured to measure the rotational speed and/or the shock frequency of the vehicle 200 at predetermined measurement cycles. For example, the predetermined measurement cycle may be based on a sampling rate of an analog digital converter of the detection control circuit 302 and/or a sampling rate or frequency of the plurality of sensors 304, 306 to acquire the rotational speed of the wheel 224. The detection circuit 222 may be positioned proximate to and/or coupled with one or more axles and/or wheels 224 of the vehicle 200. The detection circuit 222 may store the rotational speed data and/or the shock frequency data in the memory 308 and/or the memory 212, which is accessed by the controller circuit 202. Optionally, the rotational speed data and/or the shock frequency data may be transmitted via the communication circuit 210 to another vehicle (e.g., the vehicles 104-108) within the vehicle system 102 and/or to a remote system (e.g., dispatch facility). The memory 308 may be similar to and/or the same as the memory 212.

The sensor 304 may be configured to acquire a rotational speed of one or more wheels 224 of the vehicle 200. The sensor 304 may include one or more hall sensors, rotary sensors, magnetic sensors, optical sensors, tachometers, bearingless speed sensors, and/or the like. For example, the sensor 304 may be positioned proximate to and/or coupled with the axle and/or the wheel 224 to measure a rotational speed of the wheel 224. Optionally, the detection circuit 222 may include a plurality of the sensor 304, each positioned at different axles and/or wheels 224 of the vehicle 200. For example, the detection circuit 222 may include a first and second sensor 304 positioned at a first and second wheel 224, respectively, of the vehicle 200. Each first and second sensor 304 are configured to measure a rotational speed of the first and second wheel 224, respectively.

The sensor 304 may generate a speed measurement signal representing the rotational speed of the axle and/or the wheel 224 measured by the sensor 304. For example, the speed measurement signal may be an electrical waveform having one or more electrical characteristics (e.g., amplitude, frequency, voltage, current, and/or the like) representing the rotational speed of the wheel 224. Additionally or alternatively, the speed measurement signals may be a digital signal having a series of bits corresponding to the rotational speed of the axle and/or the wheel 224. The speed measurement signal may be received by the detection control circuit 302 and/or stored in the memory 308 and/or 212.

The sensor 306 may be configured to measure changes in a vertical position and/or lateral position of the vehicle 200, such as the chassis 208, over time. For example, the sensor 306 may be physically coupled to the chassis 208. The vertical position of the vehicle 200 may correspond to a position of the chassis 208 along a vertical axis 250 (FIG. 2). The lateral position of the vehicle 200 may correspond to a position of the chassis 208 along a lateral axis 254 (FIG. 2). The sensor 306 may include one or more accelerometers, LIDAR, a position sensor, proximity sensor, and/or the like. The sensor 304 may generate a position measurement signal, which is received and/or acquired by the detection control circuit 302. The position measurement signal may be one or more electrical waveforms having one or more electrical characteristics (e.g., amplitude, frequency, voltage, current, and/or the like) representing a vertical and/or lateral position of the chassis 208. For example, the sensor 306 may generate a position measurement signal having two electrical waveforms. The first electrical waveform corresponding to a position of the chassis 208 along a vertical axis 250, and the second electrical waveform corresponding to a position of the chassis 208 along a lateral axis 254 (e.g., orthogonal to movement of the vehicle 200 along an axis 252). In another example, the sensor 306 may generate an electrical waveform corresponding to a proper acceleration of the sensor 306 associated with a vertical position. Additionally or alternatively, the position measurement signal may be a digital signal having a series of bits corresponding to the vertical and/or lateral position of the sensor 306.

The position measurement signal generated by the sensor 306 may be received by the detection control circuit 302. The detection control circuit 302 may include or represent one or more hardware circuits or circuitry that include, are connected with, or that both include and are connected with one or more processors, controllers, or other hardware logic-based devices. Additionally or alternatively, portions of the detection control circuit 302 may be a part of the controller circuit 202. For example, the operations of the detection control circuit 302 may be integrated with (e.g., performed by) the controller circuit 202. The detection control circuit 302 may be configured to determine a shock frequency based on the position measurement signals. For example, in connection with FIG. 4, the detection control circuit 302 may identify a plurality of peaks 410 of a position measurement signal 406 corresponding to anomalies of the wheel 224.

Figure 4:
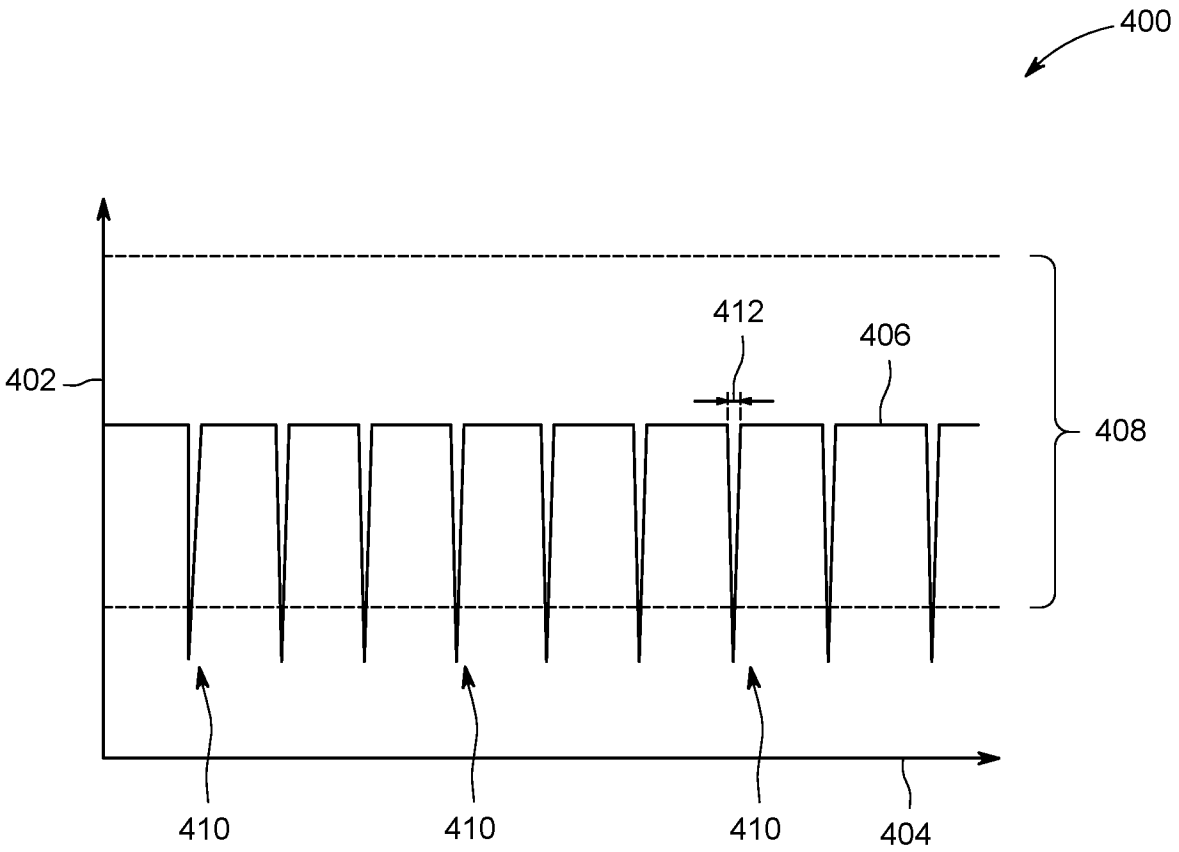
FIG. 4 is a graphical illustration of a position measurement signal generated by a sensor of the detection circuit shown in FIG. 3, in accordance with an embodiment.

FIG. 4 is a graphical illustration 400 of the position measurement signal 406 generated by the sensor 306. The graphical illustration 400 includes a vertical axis 402 representing a position, such as a vertical position, of the vehicle 200, and a horizontal axis 404 representing time. The position measurement signal 406 may be received by the detection control circuit 302 and/or accessed by the detection control circuit 302 in the memory 308 and/or the memory 212. The position measurement signal 406 includes the peaks 410 corresponding to changes in the vertical position of the vehicle 200. The peaks 410 correspond to shocks of the vehicle 200 based on a peak width 412. For example, the peaks 410 represent a change in the vertical position of the vehicle 200 within a short time period, such as less than one second, defining the peak width 412.

It may be noted that the peaks 410 also correspond to anomalies based on the changes in position of the vehicle 200. In various embodiments, the peaks 410 may represent an anomalies condition of the wheel 224. For example, one or more of the peaks 410 may correspond to a damaged section of a rolling surface of the wheel 224 that makes contact with the route 110. The damaged section may correspond to a change in shape (e.g., flat spot) of the wheel 224. When the damaged section is directly adjacent to the route 110, the change in shape between the damaged section with respect to the remaining rolling surface of the wheel 224 adjusts a vertical position of the vehicle 200 (e.g., the chassis 208), which form the peaks 410 of the position measurement signal 406. In another example, one or more of the peaks 410 may correspond to a misalignment of the wheel 224 with respect to the route 110 traversed by the vehicle 200. For example, the rolling surface of the wheel 224 may be in contact with a portion of the route 110 indicating an edge of the route corresponding to a misalignment such as a rumble strip, railway ties, and/or the like. The misalignment adjusts a vertical position of the vehicle 200, which form the peaks 410 of the position measurement signal 406.

The detection control circuit 302 may identify the peaks 410 of the position measurement signal 406 based on a predetermined non-zero threshold 408. The predetermined non-zero threshold 408 may be stored in the memory 308 and/or 212. The predetermined non-zero threshold 408 may be based on an amount of change in the position measurement signal 406 that corresponds to an anomaly of the wheel 224. For example, the predetermined non-zero threshold 408 may be a magnitude delta relative to a rolling average of the position measurement signals 406 based on preceding position measurements. When a portion of the position measurement signal 406, such as the peaks 410, are above and/or below the predetermined non-zero threshold 408 the detection control circuit 302 may determine that the portion corresponds to an anomaly of the wheel 224. Additionally or alternatively, the predetermined non-zero threshold 408 may be based on a morphology (e.g., slope, the peak width 412, and/or the like) of the position measurement signal 406.

The detection control circuit 302 may determine a periodic relationship of the identified anomalies to determine a shock frequency. The shock frequency may correspond to a frequency at which the identified anomalies occur or are identified. For example, the detection control circuit 302 may perform a frequency analysis (e.g., Fast Fourier Transform, and/or the like) of the identified anomalies by transforming the identified anomalies from the time domain to a frequency domain to identify a shock frequency. Based on a relationship between the shock frequency and a classification bandwidth 512, the detection control circuit 302 may classify the identified anomalies as an anomalous condition (e.g., wheel damage, misalignment, and/or the like).

Figure 5:
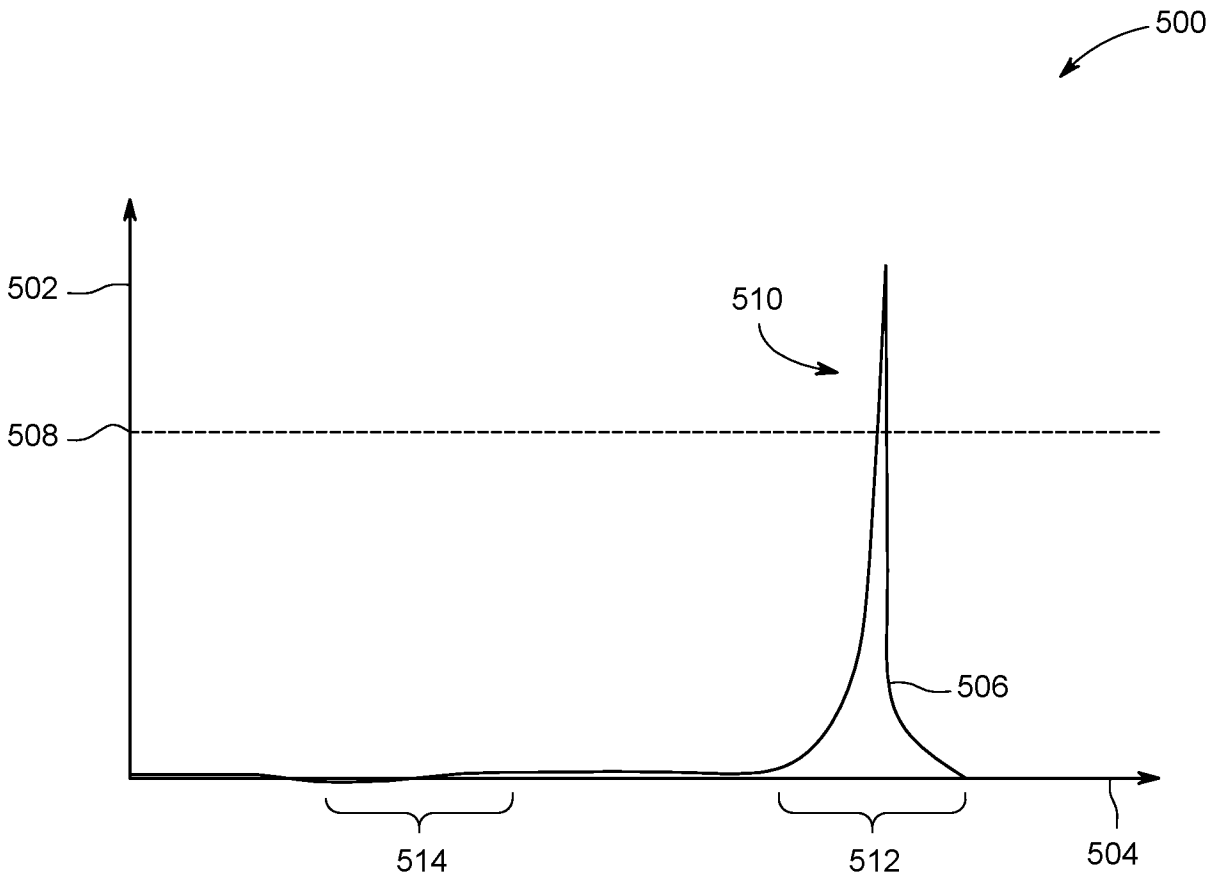
FIG. 5 is a graphical illustration of a frequency waveform of identified anomalies of the position measurement signal of FIG. 4 in a frequency domain, in accordance with an embodiment.

FIG. 5 is a graphical illustration 500 of a frequency waveform 506 of the identified anomalies (e.g., the peaks 410) of the position measurement signal 406 in a frequency domain. The horizontal axis 504 represents a frequency and a vertical axis 502 may represent an amplitude. The graphical illustration 500 includes frequency bandwidths 512 and 514. The frequency bandwidths 512 and 514 may be a range of frequencies centered about center frequencies calculated by the detection control circuit 302 and/or the controller circuit 202 (FIG. 2). The frequency bandwidths 512 and 514 may correspond to different anomalous conditions. It may be noted in various other embodiments one or more than two frequency bandwidth 512 and 514 may be calculated by the detection control circuit 302 and/or the controller circuit 202. The frequency bandwidths 512 and 514 may be based on the speed measurement signal generated by the sensor 304, a characteristic of the wheel 224 (e.g., size, diameter, circumference, and/or the like), the route 110 (e.g., railway tie distance, and/or the like), and/or the like.

For example, the frequency bandwidth 514 may be configured by the detection control circuit 302 to have a center frequency corresponding to an anomalous condition representing a damaged section of a rolling surface (e.g., flat surface, deformed shape, and/or the like) of the wheel 224. The anomalies based on the damaged section are dependent on the speed measurement signal and a characteristic of the wheel 224, such as a diameter of the wheel 224. The frequency bandwidth 514 may be defined by the detection control circuit 302 to represent a frequency of rotation of the wheel 224, which is based on the diameter of the wheel 224. For example, the detection control circuit 302 may identify a rotational speed of the wheel 224 of approximately 8.5 rotations per second based on the speed measurement signal. The detection control circuit 302 may define the frequency bandwidth 514 to be centered at a rotational frequency of the wheel 224, such as 8.5 Hz. Optionally, the detection control circuit 302 may continually adjust the frequency bandwidth 512 based on changes in the speed measurement signal corresponding to changes in the rotational speed of the wheel 224. For example, the detection control circuit 302 may move the frequency bandwidth 514 to a lower frequency when the rotational speed of the wheel 224 decreases.

In another example, the frequency bandwidth 512 may be configured by the detection control circuit 302 to have a center frequency corresponding to an anomalous condition representing the wheel 224 being misaligned (e.g., derailed) with respect to the route 110. The anomalies based on a misaligned position of the wheel 224 relative to the route 110 is dependent on the speed measurement signal and a characteristic of the route 110, such as a spacing between the rail ties, a spacing between the rumble strips, and/or the like. The frequency bandwidth 512 may be defined by the detection control circuit 302 to represent a frequency the wheel 224 traverses between the spacing of the route 110. For example, the detection control circuit 302 may identify a rotational speed of the wheel 224 of approximately 8.5 rotations per second based on the speed measurement signal. The detection control circuit 302 may identify the route 110 having rail ties with a spacing of 0.5 meters, which is stored in the memory 212. The detection control circuit 302 may define the frequency bandwidth 512 to be centered at a frequency the wheel 224 may traverse between the spacing of the rail ties, such as around 53 Hz. Optionally, the detection control circuit 302 may continually adjust the frequency bandwidth 512 based on changes in the speed measurement signal corresponding to changes in the rotational speed of the wheel 224. Additionally or alternatively, the detection control circuit 302 may adjust the frequency bandwidth 512 based on a position of the vehicle 200 along the route 110. For example, the spacing between the rail ties, rumble strips, and/or the like may change based on a position along the route 110, and the detection control circuit 302 may adjust the frequency bandwidth 512 when the spacing changes.

The detection control circuit 302 may identify one or more peaks 510 of the frequency waveform 506. The one or more peaks 510 correspond to shock frequencies of the vehicle. For example, the one or more peaks 510 may correspond to a repetitive anomaly of the wheels 224. The detection control circuit 302 may identify a selection of the one or more peaks 510 that are within one or more of the frequency bandwidths 512 and 514 to determine whether the identified anomalies correspond to one of the anomalous conditions. Optionally, the detection control circuit 302 may compare the one or more peaks 510 with a predetermined non-zero anomalous condition threshold 508. The threshold 508 may be stored in the memory 212 and/or 308. The detection control circuit 302 may determine that when an amplitude of one of the peaks 510 is above the threshold 508, the identified anomalies correspond to an anomalous condition.

For example, the peak 510 is determined by the detection control circuit 302 to be within the frequency bandwidth 512. The detection control circuit 302 may compare the amplitude of the peak 510 with the threshold 508 to determine if the identified anomalies forming the peak 510 correspond to an anomalous condition. Since the peak 510 is above the threshold 508, the detection control circuit 302 may determine that the identified anomalies are the anomalous condition corresponding to the frequency bandwidth 512, such as the wheel 224 being misaligned. Optionally, when the anomalous condition is identified by the detection control circuit 302, the detection control circuit 302 may transmit an alert to the controller circuit 202 and/or adjust an operation of the vehicle 200 (e.g., change a speed of the vehicle 200, adjust a schedule of the vehicle, and/or the like).

Returning to FIG. 2, the controller circuit 202 is connected to an input device 204 and the display 206. The controller circuit 202 may receive manual input from an operator of the vehicle 200 through the input device 204, such as a keyboard, touchscreen, electronic mouse, microphone, or the like. For example, the controller circuit 202 can receive manually input changes to characteristics of the wheel 224, information on the route 110 (e.g., length of spacing between rail ties), and/or the like, from the input device 204.

The display 206 may include one or more liquid crystal displays (e.g., light emitting diode (LED) backlight), organic light emitting diode (OLED) displays, plasma displays, CRT displays, and/or the like. For example, the controller circuit 202 can present the status and/or details of the vehicle system 102, anomalous conditions identified by the detection circuit 222, identities and statuses of alternative vehicles within the vehicle system 102, and/or the like. Optionally, the display 206 may be a touchscreen display, which includes at least a portion of the input device 204.

Figure 6:
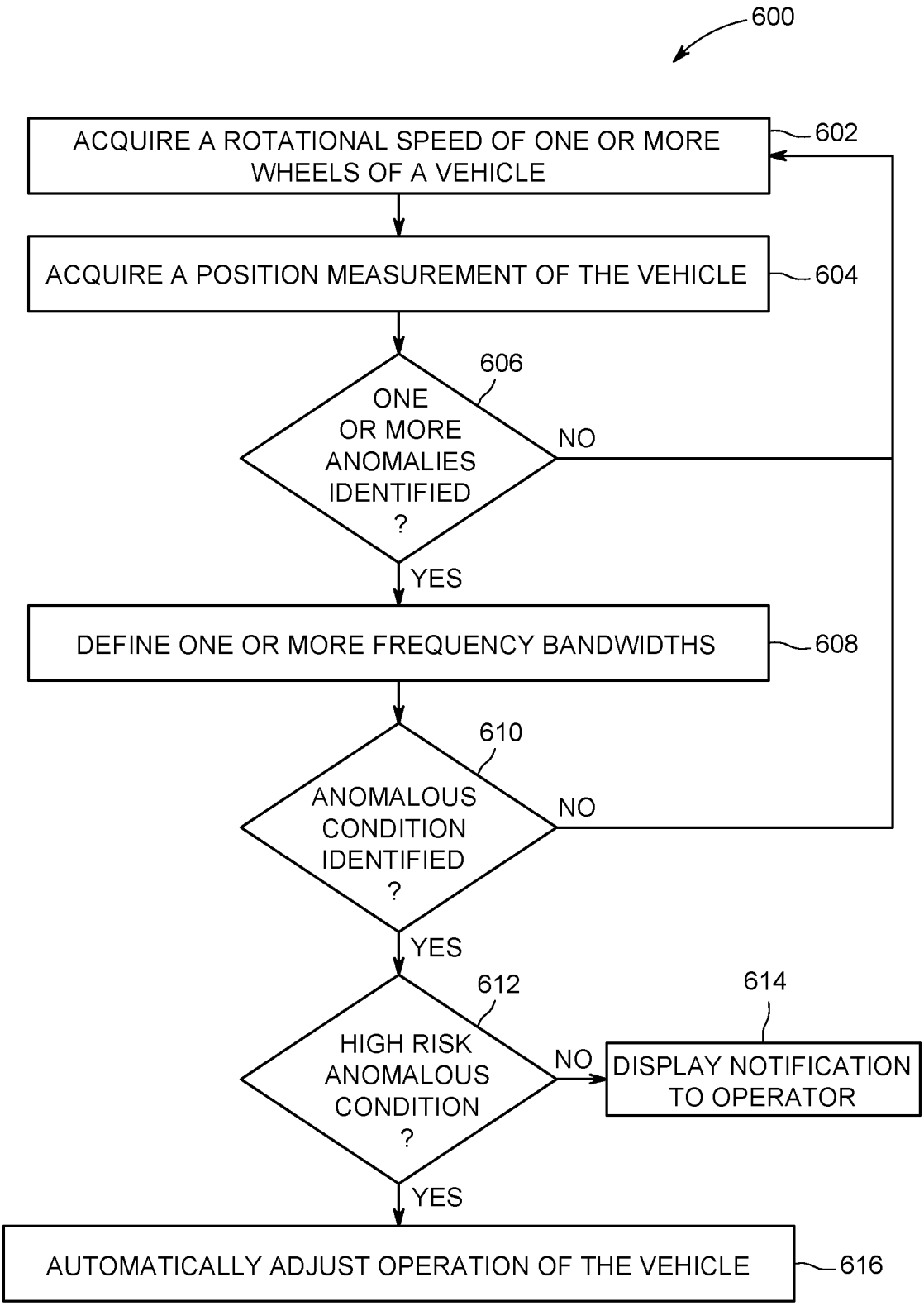
FIG. 6 illustrates a flow chart of a method for detecting anomalous conditions of one or more wheels, in accordance with an embodiment.

FIG. 6 is a flowchart of a method 600 for detecting anomalous condition of one or more wheels, in accordance with an embodiment system. The method 600, for example, may employ or be performed by structures or aspects of various embodiments (e.g., systems and/or methods) discussed herein. In various embodiments, certain operations may be omitted or added, certain operations may be combined, certain operations may be performed simultaneously, certain operations may be performed concurrently, certain operations may be split into multiple operations, certain operations may be performed in a different order, or certain operations or series of operations may be re-performed in an iterative fashion. In various embodiments, portions, aspects, and/or variations of the method 600 may be able to be used as one or more algorithms to direct hardware to perform one or more operations described herein. It should be noted, other methods may be used, in accordance with embodiments herein.

At 602, the detection control circuit 302 acquires a rotational speed of one or more wheels of a vehicle. For example, the detection control circuit 302 is operatively coupled to one or more sensors 304 configured to acquire a rotational speed of the one or more wheels 224 of the vehicle 200. Each of the one or more sensors 304 generate a speed measurement signal that is received by the detection control circuit 302. The speed measurement signal includes one or more electrical characteristics (e.g., frequency, amplitude, voltage, current, bit sequence) configured by the one or more sensors 304 to correspond to the measured rotational speed of the wheels 224, which is identified by the detection control circuit 302.

At 604, the detection control circuit 302 acquires a position measurement of the vehicle. For example, the detection control circuit 302 is operatively coupled to the sensor 306 configured to measure changes in a vertical and/or lateral position of the chassis 208 of the vehicle 200 over time. The sensor 306 generates the position measurement signal that is received by the detection control circuit 302. The position measurement signal (e.g., the position measurement signal 406 of FIG. 4) may include one or more electrical characteristics (e.g., frequency, amplitude, voltage, current, bit sequence) configured by the sensor 306 to correspond to a position of the chassis 208, which is identified by the detection control circuit 302.

At 606, the detection control circuit 302 identifies if one or more anomalies have occurred. For example, the detection control circuit 302 may identify one or more peaks 410 (FIG. 4) of the position measurement signal 406. The detection control circuit 302 may compare each of the peaks with a predetermined non-zero threshold 408 to determine if the peak 410 corresponds to an anomaly. For example, if the amplitude of the peak 410 is below and/or above the threshold 408 the detection control circuit 302 may determine that the peak 410 is an anomaly.

If one or more anomalies are identified, then at 608 the detection control circuit 302 defines one or more frequency bandwidths. The one or more frequency bandwidths may correspond to a frequency range that represents an anomalous condition. For example, the frequency bandwidth 514 (FIG. 5) may be centered at a frequency defining when the wheel 224 is derailed and/or not aligned with the route 110. In another example, the frequency bandwidth 512 may be centered at a frequency defining when the wheel 224 is damaged. The detection control circuit 302 may define the one or more frequency bandwidths based on the anomalous condition represented at the corresponding frequency bandwidth. For example, the detection control circuit 302 may define the frequency bandwidth 512 corresponding to damage of the wheel 224 based on the rotational speed of the wheel 224 and a characteristic of the wheel 224, such as the diameter, radius, circumference, and/or the like. In another example, the detection control circuit 302 may define the frequency bandwidth 514 corresponding to misalignment of the wheel 224 relative to the route 110 based on the rotational speed of the wheel 224 and a characteristics of the wheel 224, such as a length of the spacing of the rail ties, rumble strip, and/or the like.

At 610 the detection control circuit 302 determines whether the one or more anomalies correspond to an anomalous condition. For example, the detection control circuit 302 may transform the identified anomalies from a time domain to a frequency domain (e.g., perform a Fast Fourier Transform, and/or the like) to form the frequency waveform 506 (FIG. 5). Identified anomalies that are recurring and/or periodic forming the one or more peaks 510 of the frequency waveform 506. The detection circuit 302 may select the one or more peaks 510 within one of the frequency bandwidths 512, 514 to compare with the predetermined non-zero anomalous condition threshold 508. If the selected peak 510 is above the threshold 508, the detection control circuit 302 determines that the peak 510 corresponds to an anomalous condition.

Additionally or alternatively, the controller circuit 202 may determine whether the one or more anomalies are associated internally with the vehicle 200 (e.g., damaged section of the wheel 224) or external to the vehicle 200 (e.g., based on the route 110). For example, the controller circuit 202 may be configured to acquire the rotational speed of the one or more wheels and position measurements of alternative vehicles of the vehicle system 102 via the communication circuit 210. The controller circuit 202 may determine one or more anomalies (e.g., at 606-610) based on the rotational speed and position measurements of the alternative vehicles. The controller circuit 202 may compare the identified one or more anomalies of the alternative vehicles with the identified anomalies of the vehicle 200. For example, the controller circuit 202 identifies at least one of the anomalies of the alternative vehicles occur at a peak (e.g., one of the one or more peaks 510 shown in FIG. 5) at and/or within a predetermined threshold of a peak of at least one of the anomalies of the vehicle 200. The controller circuit 202 may determine that since both anomalies of the vehicle 200 and the alternative vehicle occur at the same peak, the anomalies are external to the vehicle 200, such as based on the route 110.

If an anomalous condition is identified, then at 612 the detection control circuit 302 determines if the anomalous condition is a high risk. Each anomalous condition may have a corresponding assigned risk. For example, the memory 308 may include a database of a plurality of anomalous conditions, each having a corresponding risk value. The risk value may be associated with an amount of damage to the vehicle 200 caused by the anomalous condition. For example, the anomalous condition corresponding to a damaged section of the wheel 224 may be lower than the anomalous condition corresponding to the wheel misaligned with the route 110. The detection control circuit 302 may compare the anomalous condition identified to with the plurality of anomalous conditions in the memory 308 to identify a matching anomalous condition with a corresponding risk value.

If the anomalous condition is not high risk, then at 614 the controller circuit 202 may display a notification to an operator of the vehicle. Additionally or alternatively, if the anomalous condition is high risk, then at 616 controller circuit 202 may automatically adjust operation of the vehicle. For example, the detection control circuit 302 may transmit the anomalous condition and the risk value to the controller circuit 202. Based on the risk value, the controller circuit 202 may determine one or more predetermined actions. For example, the memory 212 may include a data base of a plurality of candidate actionable items with corresponding risk values. The candidate actionable items may include displaying a notification on the display 206, requesting a confirmation from the operator via the input device 204, transmit the anomalous condition to an alternative vehicle within the vehicle system 200 and/or a remote system via the communication circuit 210, and/or the like. Additionally or alternatively, the actionably items may include automatically adjusting an operation of the vehicle 200. For example, based on the risk value the controller circuit 202 may adjust a speed of the vehicle system 102.

The controller circuit 202 may compare the risk value received from the detection control circuit 302 with risk values stored in the memory 212 having a corresponding actionable item. For example, the detection control circuit 302 identifies the anomalous condition as a damaged wheel 224 having a corresponding first risk value. The controller circuit 202 may compare the risk value with the plurality of risk value stored in the memory 212 to determine the actionable item corresponds to displaying a notification on the display 206 to inform the operator.

In another example, the detection control circuit 302 identifies the anomalous condition as a misaligned wheel 224 with respect to the route 110 having a corresponding high risk value. The controller circuit 202 may compare the risk value with the plurality of risk value stored in the memory 212 to determine the actionable item corresponds to automatically adjusting operation of the vehicle. For example, the controller circuit 202 may reduce a speed of the vehicle 200 and/or vehicle system 102. Additionally or alternatively, the controller circuit 202 may transmit a notification to alternative vehicle system 102 traveling the route 110 and/or to a remote system (e.g., dispatch facility).

In one embodiment, a control system (such as one or more controllers of the vehicle systems described herein) may have a local data collection system deployed that may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the control system may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In one embodiment a system (e.g., a vehicle system) is provided. The system includes a detection circuit having a first and second sensor. The first sensor is configured to measure a rotational speed of a first wheel. The second sensor is coupled to a vehicle chassis and configured to measure a position over time of the vehicle chassis. The system further includes a controller circuit configured to determine a shock frequency based on the position of the vehicle chassis. The controller circuit is further configured to determine an anomalous condition of the first wheel based on the shock frequency and the rotational speed.

Optionally, the anomalous condition is damage to a rolling surface of the first wheel or a misalignment of the wheel with respect to a route.

Optionally, the controller circuit is configured to define a frequency bandwidth based on the rotational speed and at least one of a characteristic of the first wheel or a characteristic of a route. Additionally or alternatively, the controller circuit is further configured to determine the anomalous condition based on a position of the shock frequency with respect to the frequency bandwidth. Additionally or alternatively, the characteristic of the first wheel corresponding to a radius, circumference, or diameter. Additionally or alternatively, the characteristic of the route correspond to a spacing between rail ties.

Optionally, the system further includes a second wheel and a third sensor. The third sensor may be configured to measure rotational speed of the second wheel. The controller circuit may be configured to determine an anomalous condition of the second wheel based on the shock frequency and the rotational speed of the second wheel.

Optionally, the system further includes a display configured to display a notification based on the anomalous condition.

Optionally, the controller is configured to automatically adjust a speed of the vehicle based on the anomalous condition.

Optionally, the system further includes a communication circuit configured to transmit the anomalous condition to an alternative vehicle or a remote system.

Optionally, the second sensor is an accelerometer. The position corresponding to a vertical position of the vehicle chassis.

In another embodiment a method (e.g., for detecting anomalous conditions of one or more wheels) is provided. The method includes acquiring a rotational speed of a first wheel from a first sensor, acquiring a position over time of a vehicle chassis from a second sensor, calculating a shock frequency based on the position of the vehicle chassis, and determining an anomalous condition of the first wheel based on the shock frequency and the rotational speed.

Optionally, the anomalous condition is damage to a rolling surface of the first wheel or a misalignment of the wheel with respect to a route.

Optionally, the method includes defining a frequency bandwidth based on the rotational speed and at least one of a characteristic of the first wheel or a characteristic of a route. Additionally or alternatively, the determining operation is based on a position of the shock frequency with respect to the frequency bandwidth. Additionally or alternatively, the characteristic of the first wheel corresponding to a radius, circumference, or diameter. Additionally or alternatively, the characteristic of the route correspond to a spacing between rail ties.

Optionally, the method further includes displaying a notification on a display based on the anomalous condition.

Optionally, the method further includes automatically adjusting a speed of the vehicle based on the anomalous condition.

In another embodiment a method (e.g., for detecting anomalous conditions of one or more wheels) is provided. The method includes receiving a speed measurement signal from a first sensor and a position measurement signal from a second sensor. The speed measurement signal corresponds to a rotational speed of a first wheel. The position measurement signal corresponding to a position of a vehicle chassis. The method further includes identifying a plurality of anomalies in the position measurement signal, calculating a shock frequency based on at least a portion of the plurality of anomalies, and determining an anomalous condition of the first wheel based on the shock frequency and the rotational speed.

In another embodiment, a vehicle control system includes, for a vehicle having a first wheel and a vehicle chassis, a detection circuit and a controller circuit. The detection circuit includes a first sensor and a second sensor. The first sensor is configured to measure a rotational speed of the first wheel. The second sensor is coupled to the vehicle chassis and is configured to measure a position over time of the vehicle chassis. The controller circuit is configured to determine a shock frequency based on the position of the vehicle chassis. The controller circuit is further configured to determine a condition (e.g., an anomalous condition) of the first wheel based on the shock frequency and the rotational speed, and to control the vehicle (e.g., change of speeds, change of route, stop the vehicle) based on the condition that is detected.

In another embodiment, a vehicle control system includes, for a vehicle having a first wheel, a second wheel, and a vehicle chassis, a detection circuit and a controller circuit. The detection circuit includes a first sensor, a second sensor, and a third sensor. The first sensor is configured to measure a rotational speed of the first wheel. The second sensor is coupled to the vehicle chassis and is configured to measure a position over time of the vehicle chassis. The third sensor is configured to measure rotational speed of the second wheel. The controller circuit is configured to determine a shock frequency based on the position of the vehicle chassis. The controller circuit is further configured to determine a condition (e.g., an anomalous condition) of the first wheel based on the shock frequency and the rotational speed of the first wheel. The controller circuit is further configured to determine a condition (e.g., an anomalous condition) of the second wheel based on the shock frequency and the rotational speed of the second wheel. The controller circuit is further configured to control the vehicle (e.g., change of speeds, change of route, stop the vehicle) based on the condition of the first wheel and the condition of the second wheel that are detected.

As used herein, the terms "module", "system," "device," "circuit", or "unit," may include a hardware and/or software system and circuitry that operates to perform one or more functions. For example, a module, unit, device, circuit, or system may include one or more processors, controller, or other logic-based device that performs operations based on instructions stored on a tangible and non-transitory computer readable storage medium, such as a computer memory. Alternatively, a module, unit, device, circuit, or system may include a hard-wired device that performs operations based on hard-wired logic and circuitry of the device. The modules, units, circuit, or systems shown in the attached figures may represent the hardware and circuitry that operates based on software or hardwired instructions, the software that directs hardware to perform the operations, or a combination thereof. The modules, systems, devices, circuit, or units can include or represent hardware circuits or circuitry that include and/or are connected with one or more processors, such as one or computer microprocessors.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or operations, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system, comprising:

a movement sensor configured to measure one or more characteristics of movement of a vehicle; and a controller configured to identify a repeated event in the one or more characteristics of the movement of the vehicle, wherein the one or more characteristics are other than rotational speed of a wheel of the vehicle, the controller further configured to determine a frequency associated with the repeated event, and the controller further configured to determine a state of a route being traveled upon by the vehicle based, at least in part, on the frequency associated with the repeated event.

2. The system of claim 1, wherein the controller is configured to determine the state of the route being traveled upon by the vehicle based on the rotational speed of the wheel and the frequency associated with the repeated event.

3. The system of claim 1, further comprising a speed sensor configured to measure the rotational speed of the wheel of the vehicle.

4. The system of claim 1, wherein the controller is further configured to determine a state of the wheel based on the rotational speed of the wheel and the frequency associated with the repeated event.

5. The system of claim 4, wherein the controller if further configured to determine the state of the wheel as damage to a rolling surface of the wheel or a misalignment of the wheel with respect to the route.

6. The system of claim 1, wherein the controller is configured to determine the state of the route based on which of several different ranges of frequencies in which the frequency associated with the repeated event is located.

7. The system of claim 6, wherein the different ranges of frequencies are associated with different states of one or more of the wheel or the route.

8. The system of claim 6, wherein the different ranges of frequencies are associated with different sizes of the wheel.

9. The system of claim 6, wherein the different ranges of frequencies are associated with different rotational speeds of the wheel.

10. The system of claim 6, wherein the different ranges of frequencies are associated with different characteristics of the route.

11. The system of claim 1, wherein the controller is configured to change the movement the vehicle based on the state of the route.

12. A method, comprising:

measuring one or more characteristics of movement of a vehicle;

identifying a repeated event in the one or more characteristics of the movement of the vehicle, wherein the one or more characteristics are other than rotational speed of a wheel of the vehicle;

determining a frequency associated with the repeated event; and determining a state of a route being traveled upon by the vehicle based, at least in part, on the frequency associated with the repeated event.

13. The method of claim 12, further comprising:

determining the rotational speed of the wheel; and determining the one or more characteristics of movement of the vehicle.

14. The method of claim 12, further comprising determining the state of the route being traveled upon by the vehicle based on the rotational speed of the wheel and the frequency associated with the repeated event.

15. The method of claim 12, further comprising determining a state of the wheel based on the rotational speed of the wheel and the frequency associated with the repeated event, and wherein the state of the wheel is determined as damage to a rolling surface of the wheel or a misalignment of the wheel with respect to the route.

16. The method of claim 12, wherein the state of the route is determined based on which of several different ranges of frequencies in which the frequency associated with the repeated event is located.

17. The method of claim 16, wherein the different ranges of frequencies are associated with different states of the route.

18. The method of claim 16, wherein the different ranges of frequencies are associated with different characteristics of the route.

19. The method of claim 12, further comprising:

changing the movement of the vehicle based on the state of the route.

* * * * *